US008499701B2

(12) United States Patent
Ritzberger

(10) Patent No.: US 8,499,701 B2
(45) Date of Patent: Aug. 6, 2013

(54) LARGE LOAD CARRIER

(75) Inventor: Axel Ritzberger, Altendorf (CH)

(73) Assignee: Georg Utz Holding AG, Bremgarten (CH)

( * ) Notice: Subject to any disclaimer, the term of this patent is extended or adjusted under 35 U.S.C. 154(b) by 0 days.

(21) Appl. No.: 13/503,540

(22) PCT Filed: Oct. 27, 2010

(86) PCT No.: PCT/EP2010/006546
§ 371 (c)(1),
(2), (4) Date: Apr. 23, 2012

(87) PCT Pub. No.: WO2011/054465
PCT Pub. Date: May 12, 2011

(65) Prior Publication Data

US 2012/0204768 A1 Aug. 16, 2012

(30) Foreign Application Priority Data

Nov. 6, 2009 (DE) ..... 10 2009 060 970

(51) Int. Cl.
*B65D 19/38* (2006.01)

(52) U.S. Cl.
USPC ..... 108/57.25; 108/56.1

(58) Field of Classification Search
USPC ..... 108/57.25, 901, 902, 57.26, 57.28, 108/51.3, 56.1, 56.3
See application file for complete search history.

(56) References Cited

U.S. PATENT DOCUMENTS

| | | | | |
|---|---|---|---|---|
| 3,405,666 | A * | 10/1968 | Miller | 108/57.1 |
| 5,868,080 | A * | 2/1999 | Wyler et al. | 108/57.25 |
| 5,937,767 | A * | 8/1999 | Togawa et al. | 108/57.26 |
| 6,125,770 | A * | 10/2000 | Brandenburg | 108/57.25 |
| 6,173,659 | B1 * | 1/2001 | Danks et al. | 108/54.1 |
| 6,622,641 | B2 * | 9/2003 | Smyers | 108/56.1 |
| 6,718,888 | B2 * | 4/2004 | Muirhead | 108/57.25 |
| 6,807,910 | B2 * | 10/2004 | Apps | 108/57.25 |
| 6,840,181 | B2 * | 1/2005 | Smyers | 108/56.1 |
| 6,986,309 | B2 * | 1/2006 | Sugihara et al. | 108/57.25 |
| 7,748,330 | B2 | 7/2010 | Dubois et al. | |
| 2001/0029874 | A1 * | 10/2001 | Muirhead | 108/57.25 |
| 2003/0061974 | A1 * | 4/2003 | Smyers | 108/56.1 |

(Continued)

FOREIGN PATENT DOCUMENTS

| | | |
|---|---|---|
| DE | 10 2004 049 201 | 4/2006 |
| DE | 20 2008 011 418 | 1/2009 |
| GB | 2 369 349 | 5/2002 |

OTHER PUBLICATIONS

International Search Report of PCT/EP2010/006546, Apr. 12, 2011.

*Primary Examiner* — Jose V Chen
(74) *Attorney, Agent, or Firm* — Collard & Roe, P.C.

(57) ABSTRACT

A plastic large load carrier has a base that accommodates the loads, support feet arranged at least at the corner regions of the underside of the base, and a double-walled frame surrounding the base. The inner wall and the outer wall of the frame are interconnected by vertical webs and strip-shaped protective profiled elements each being provided between two respective support feet in the lower frame area, wherein the rear of the protective profiled element is supported against the inner wall of the frame. The protective profiled element is a plastic part, on the one longitudinal edge of which an insertion strip for inserting into the gap between the inner wall and the outer wall of the frame is formed, and forms a unit with the profiled element.

9 Claims, 13 Drawing Sheets

U.S. PATENT DOCUMENTS

Figure 1:
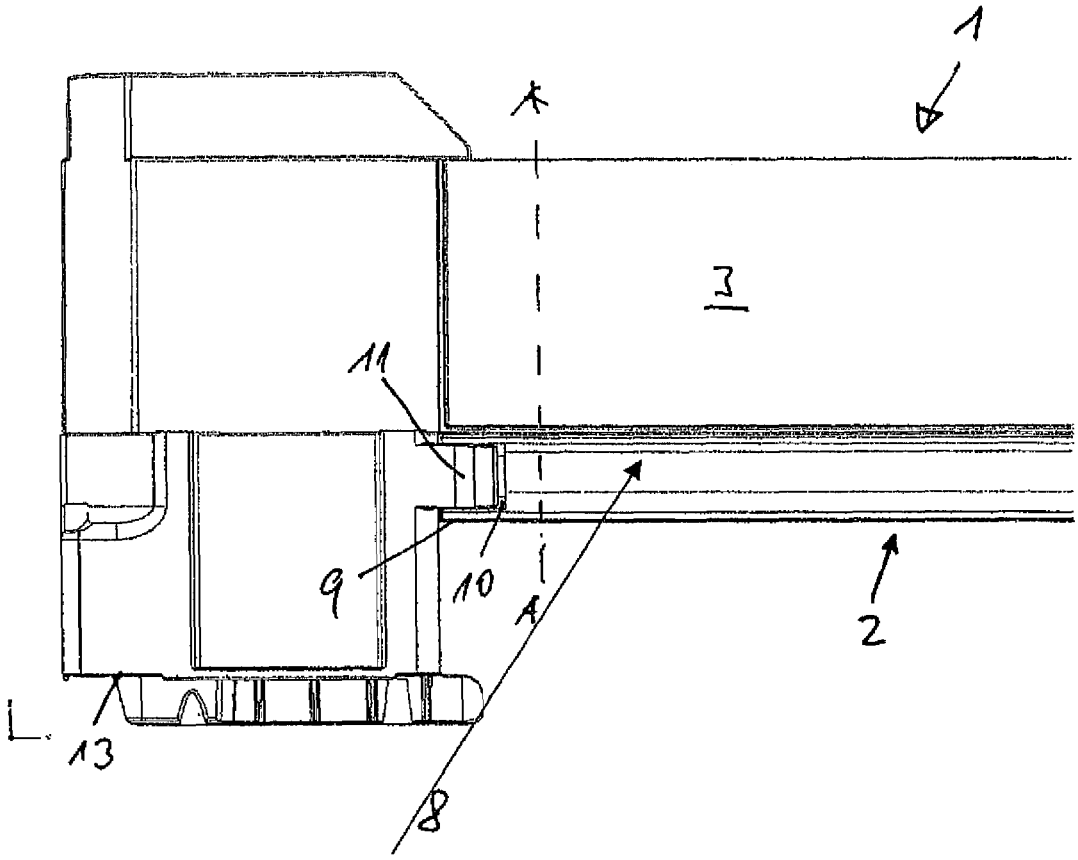

2004/0134391 A1* 7/2004 Sugihara et al. ..... 108/57.25
2006/0201399 A1* 9/2006 Swistak et al. ..... 108/57.25
2008/0178775 A1* 7/2008 Strobl et al. ..... 108/57.26
2008/0210140 A1* 9/2008 Valentinsson ..... 108/57.25
2009/0188412 A1* 7/2009 Dubois ..... 108/57.25
2010/0288169 A1* 11/2010 Du Toit ..... 108/57.25

* cited by examiner view from the front view from the rear view from the front view from the rear view from the front view from the rear view from the front view from the rear

LARGE LOAD CARRIER

CROSS REFERENCE TO RELATED APPLICATIONS

This application is the National Stage of PCT/EP2010/006546 filed on Oct. 27, 2010, which claims priority under 35, U.S.C. §119, of German Application No. 10 2009 060 970.9, filed on Nov. 6, 2009, the disclosure of which is incorporated by reference. The international application under PCT article 21(2) was not published in English.

The invention relates to a large load carrier made of plastic, having a bottom that accommodates the loads, on the underside of which standing feet are disposed at least in the corner regions, and which is surrounded by a double-wall frame, whereby the inner and outer wall of the frame are connected with one another by way of vertical crosspieces, and strip-shaped protective profiles are disposed in the lower frame region, between two standing feet, in each instance, whereby the back side of the protective profile is supported on the inner wall of the frame.

Such large load carriers are known, for example, from the German patent 10 2004 049 201. The problems that underlie the previously known large load carriers, and also the one according to the invention, can be seen in that such containers are stacked, with several of them one on top of the other, whereby the lowest container has to carry up to 3 metric tons.

For this reason, such a stack is not lifted and set down by the forklift truck driver. Instead, he moves the forks of the forklift against the lower edge of the bottommost container or the bottommost pallet in the stack, and displaces the stack in this manner, to the desired location, over a hall floor that is generally rough.

In this connection, of course, damage or destruction of the plastic container or of the pallet frequently occurs in this region.

In the case of the previously known container, this problem is supposed to be counteracted using a metal profile strip, which is disposed in the lower frame region of the container, between two standing feet. This previously known profile strip had a U-shaped cross-section open toward the front, into which the forks of the forklift are supposed to engage.

In this connection, it can, of course, happen that the forks of the forklift do not hit the U profile, but rather penetrate into the container bottom above the profile strip and cause damage here.

The invention is therefore based on the task of providing a protective profile that is as inexpensive as possible, which prevents penetration of the forks of the forklift into the container bottom.

The invention accomplishes this task in accordance with the characterizing part of claim 1, in that the protective profile is a plastic part, on the longitudinal edge of which an insertion strip for insertion into the interstice between inner and outer wall of the frame is formed on and forms a unit with the profile.

In this way, the region between the actual protective profile and the container bottom that lies behind it is bridged by means of the insertion strip, so that penetration of the forklift forks into this region is precluded.

Furthermore, the unit composed of insertion strip and protective profile is produced using the injection-molding method, and is therefore inexpensive, in any case more inexpensive than the previously known metal profile strip.

According to claim 2, it is provided that the insertion strip has recess slots for accommodating the crosspieces that connect the inner and outer wall with one another.

In this way, a secure hold within the double-wall frame is guaranteed.

Attachment of the protective profiles can take place, for example, by means of recesses in the feet, into which the ends of the profile are introduced, and afterward the foot is installed onto the container bottom.

It is also possible that the profile is put together from multiple individual elements that are screwed on or clipped on or also welded on between the ribs, within the frame.

The protective profile also does not have to consist of individual strips that reach from foot to foot, but rather can be configured as a circumferential frame element that is laid into the aforementioned recesses in the frame, and afterward the feet are installed onto the container bottom.

In the following and using the drawings, however, only the holding method known from the state of the art for attachment of the protective profiles is explained, by means of tongues formed onto the feet, whereby the tongues engage into corresponding recesses at the profile ends.

According to claim 3, it is provided that the protective profile has a cross-section that is U-shaped toward the outside, similar to the previously known metal profile.

In a further exemplary embodiment, it is provided, according to claim 4, that the protective profile has the shape of an L standing on its head in cross-section, whereby the vertical L shank is guided in an arc all the way to the inner wall of the frame, at its end.

This is therefore a profile that is open toward the bottom, in which the forks of the forklift are prevented from slipping upward by the upper L shank.

As additional protection, it is provided, according to claim 5, that a metal profile that is also L-shaped can be laid into the region having the L-shaped cross-section, which profile can also be held by the tongues formed onto the foot, in each instance. However, the attachment alternatives mentioned above can also be used here. Laying in the metal profile is optional and is generally only required if the load to be displaced is particularly great.

Another exemplary embodiment is presented by claim 6. Here, it is proposed that the protective profile has a region that proceeds vertically from the insertion strip, in cross-section, from which region a slanted region runs in the direction of the inner wall of the frame, at an obtuse angle, the end of which region has a horizontal region that is supported in the inner wall of the frame, whereby crosspieces proceed horizontally both from the vertical region and from the region that runs at a slant, which crosspieces have a distance from the inner wall of the frame in the unstressed state.

The region of the protective profile that proceeds vertically serves as an engagement surface for the forks of the forklift for displacement of the container, while the slanted region of the protective profile offers the forks a different type of engagement surface, because of its resilient properties, which are, however, limited by the horizontal crosspieces that serve as a stop, in such a manner that the container is lifted slightly and tilted, thereby facilitating its displacement.

A modification of this solution is given by the characteristic of claim 7, which differs from the preceding exemplary embodiment solely in that the vertical region of the protective profile is left out.

To protect the lower edge of the outer wall of the frame and as a stop for the forks of the forklift, it is provided, according to claim 8, that a projection that projects outward is provided on the profile, at the transition to the insertion strip part, which projection lies against the underside of the outer wall of the frame.

In all the exemplary embodiments that have been presented up to now, it is provided, according to claim 9, that the insertion strip is configured in L shape in cross-section, whereby the vertical L shank lies against the inside of the outer wall of the frame, while the horizontal L shank connects the insides of outer wall and inner wall with one another, whereby vertical intermediate walls are provided over the entire length of the insertion strip, at a distance from one another.

In this way, the insertion strip is also a component that has a light construction but is nevertheless stable, and forms a unit with the protective profile.

In connection with the protective profiles presented up to now, it has been assumed that the rear wall of the frame reaches down lower than the front wall, so that the actual protective profile is visible.

Alternatively, both walls can also have the same height, so that the protective profile disappears completely in the wall. The recesses in the feet, which are installed onto the container bottom after the profile is laid in, then serve to fix the profile in place.

In the following, the invention will be presented and explained in greater detail using drawings.

Figure 2:
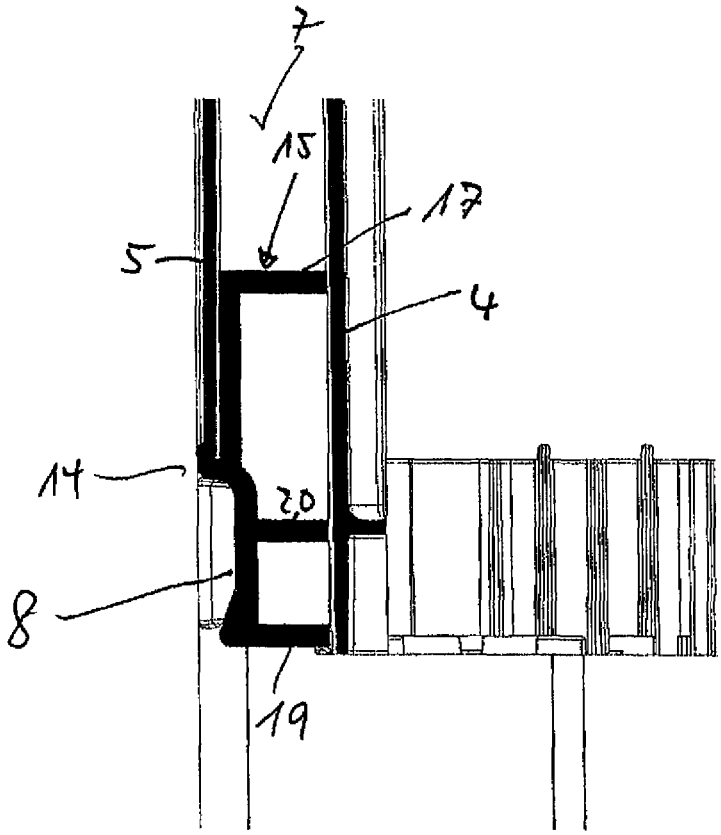

These show:

FIG. 1 the foot region of a large load carrier in a truncated representation, with a protective strip according to a first alternative FIG. 2 sectional view along the line A-A in FIG. 1

Figure 3:
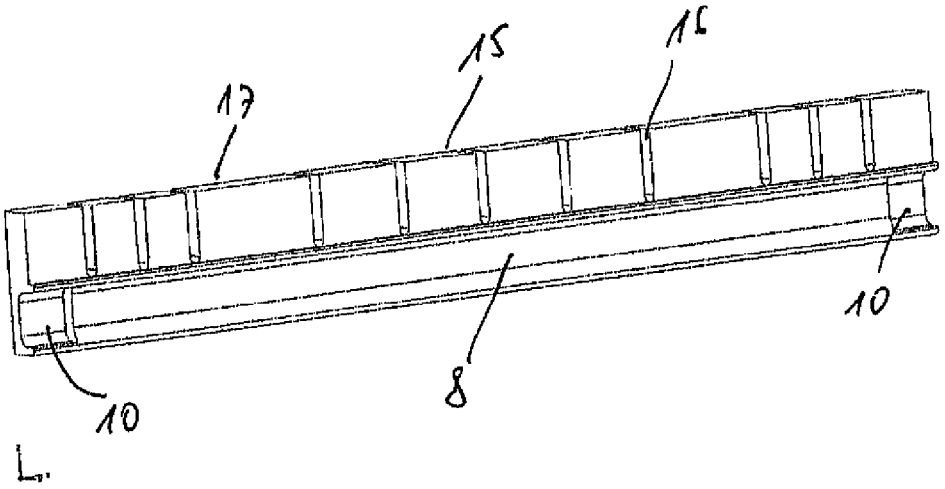
Figure 3:
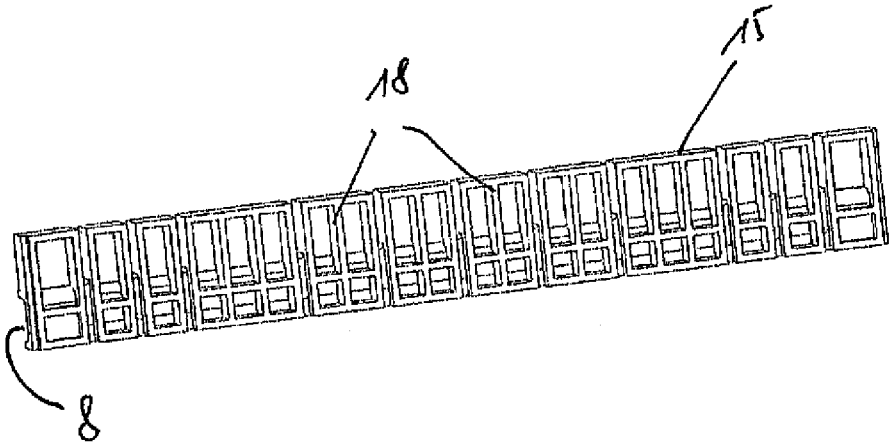
Figure 4:
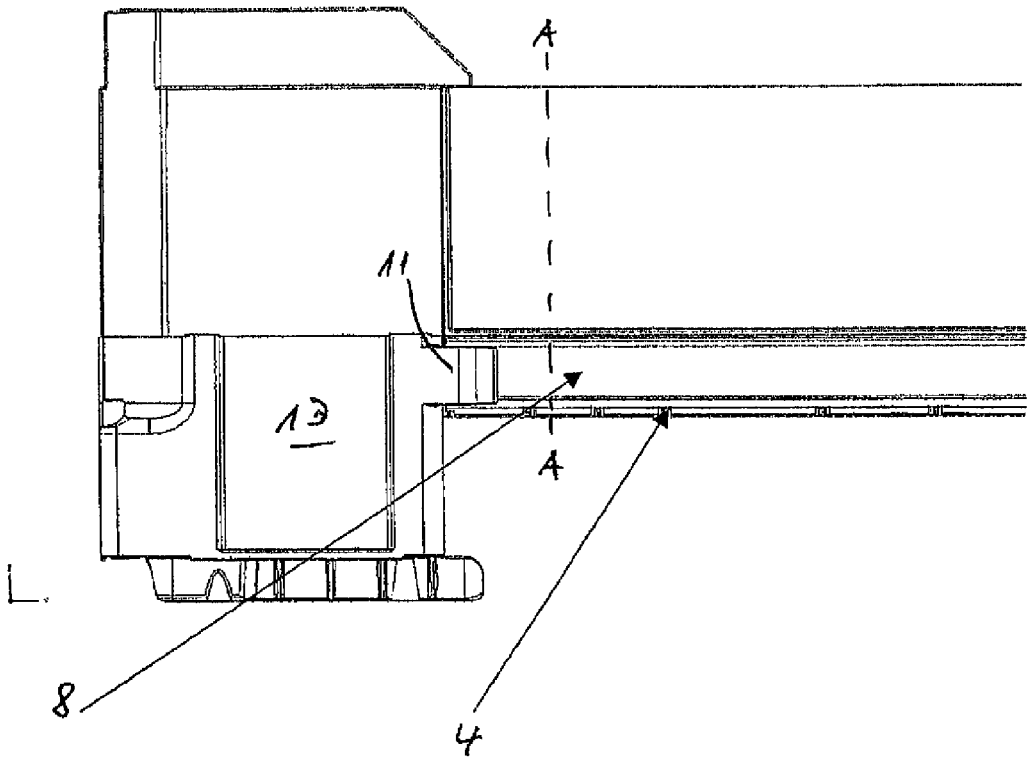
Figure 5:
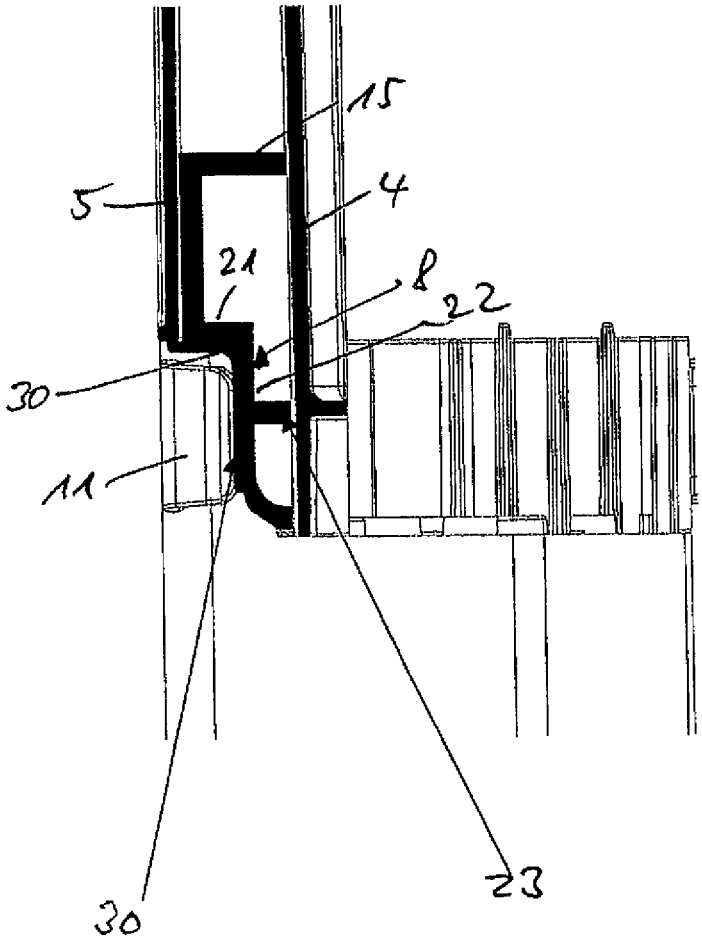

FIG. 3 view of the protective profile according to FIG. 2 from the front and from the rear FIG. 4 view according to FIG. 1 with a protective profile according to a second alternative FIG. 5 sectional view along the line A-A in FIG. 4

Figure 6:
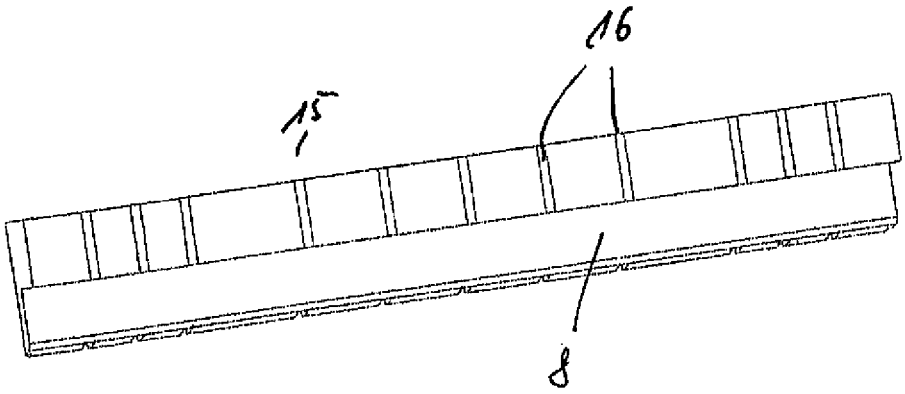
Figure 6:
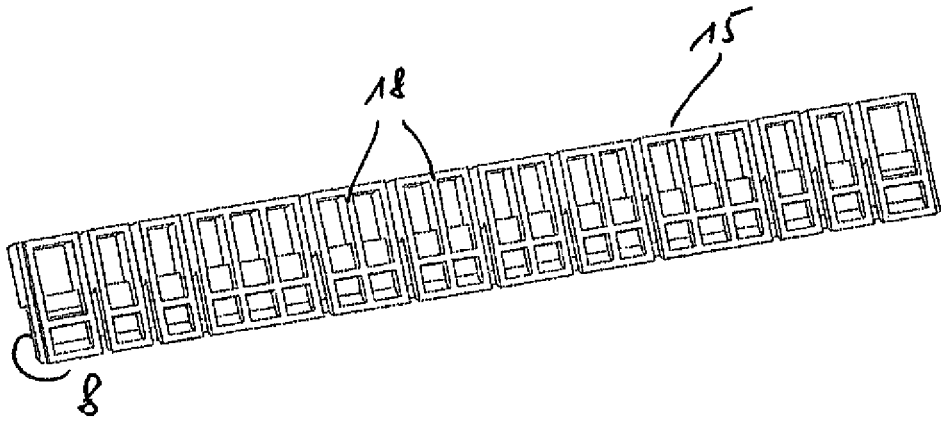
Figure 7:
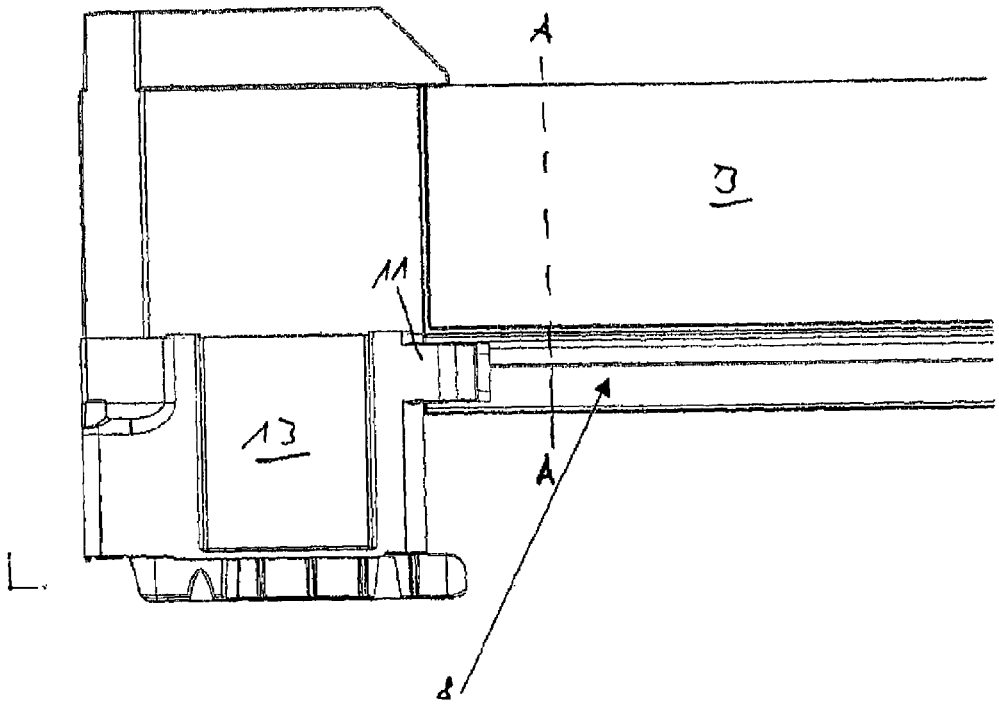
Figure 8:
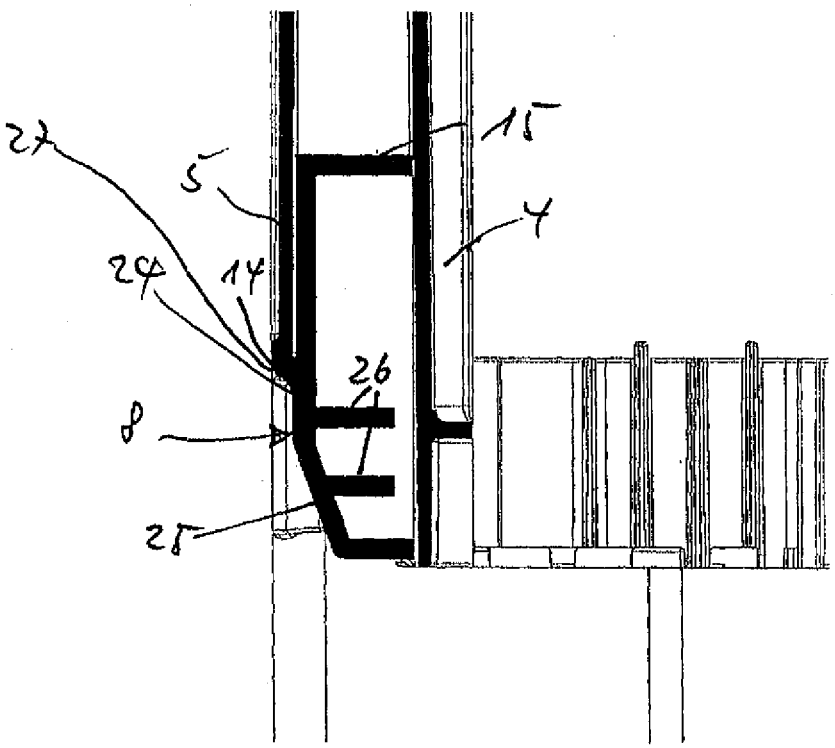

FIG. 6 protective profile according to the second alternative in a view from the front and from the rear FIG. 7 view according to FIG. 1 with a protective profile according to a third alternative FIG. 8 sectional view along the line A-A from FIG. 7

Figure 9:
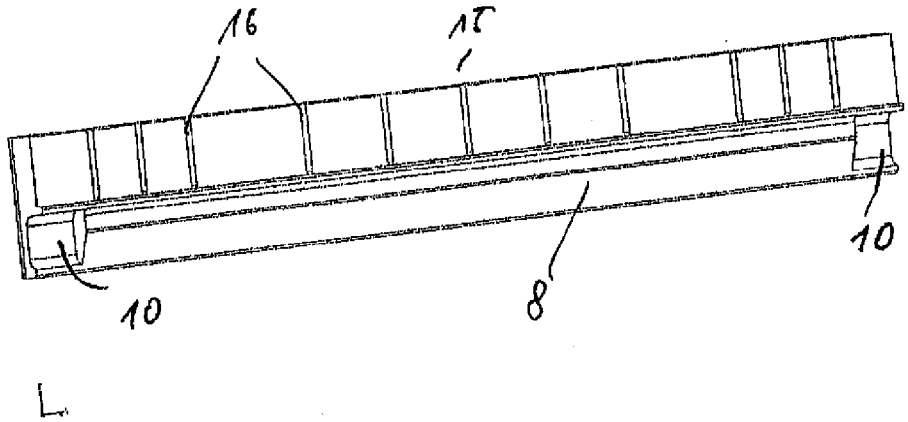
Figure 9:
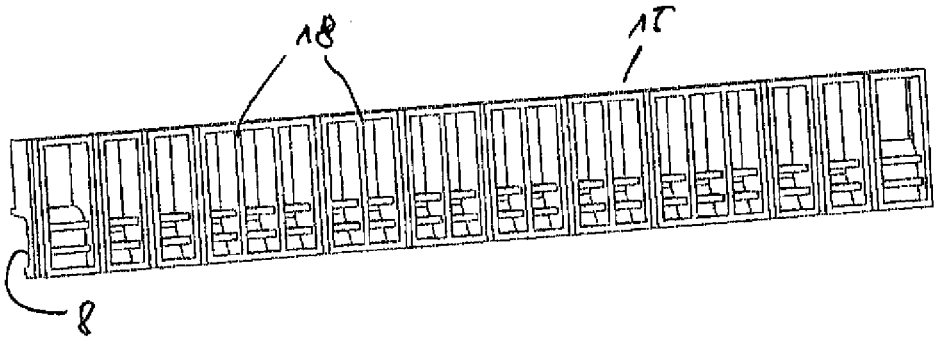
Figure 10:
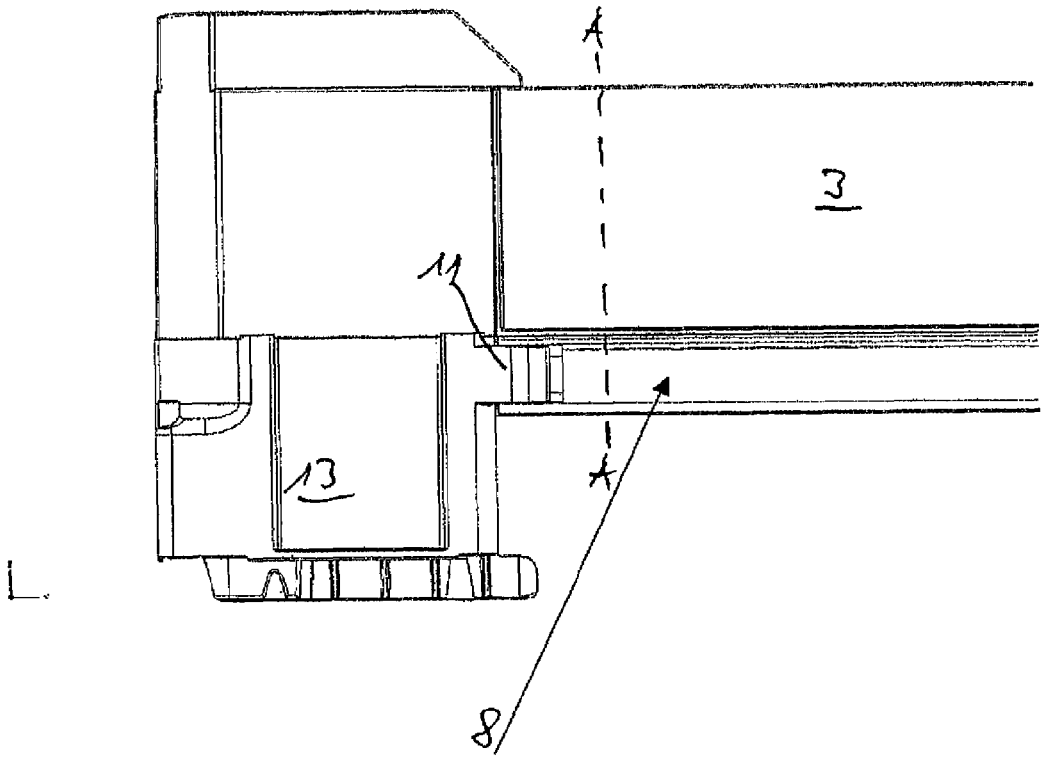
Figure 11:
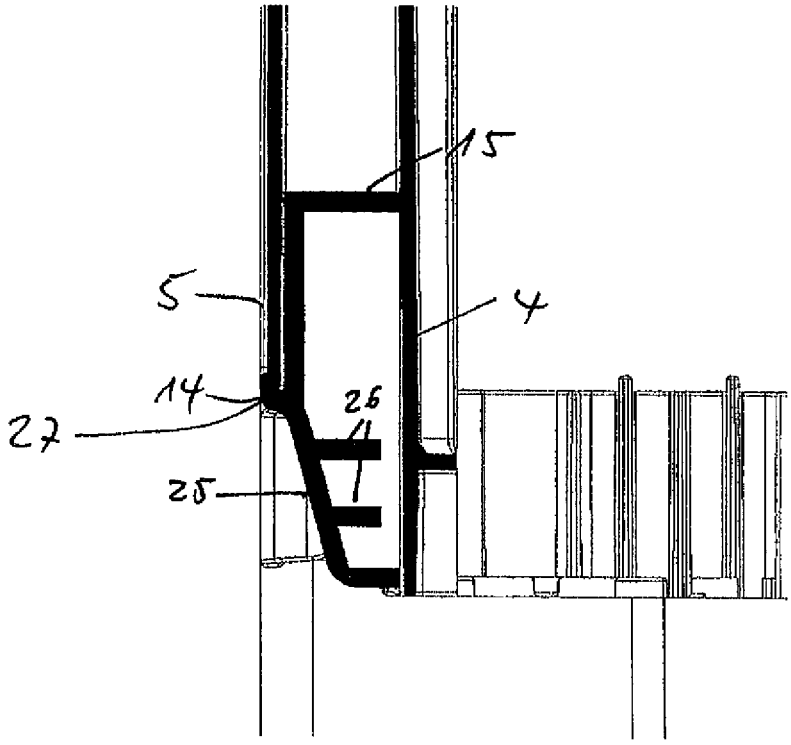

FIG. 9 protective profile according to the third alternative in a view from the front and from the rear FIG. 10 view according to FIG. 1 with a protective profile according to a fourth alternative FIG. 11 sectional view along the line A-A from FIG. 10

Figure 12:
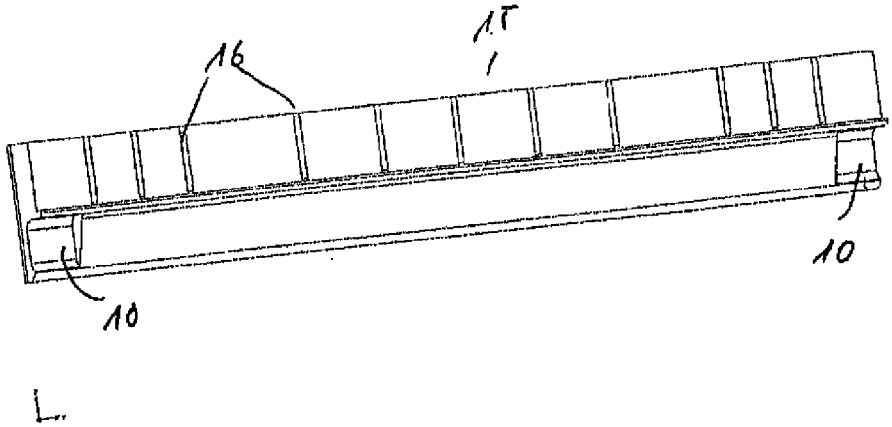
Figure 12:
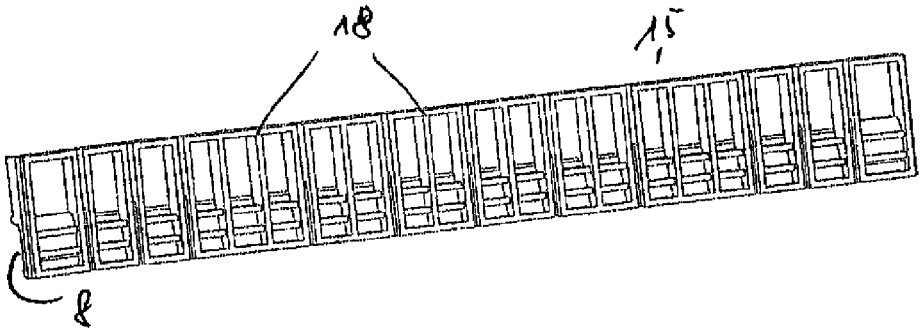
Figure 13:
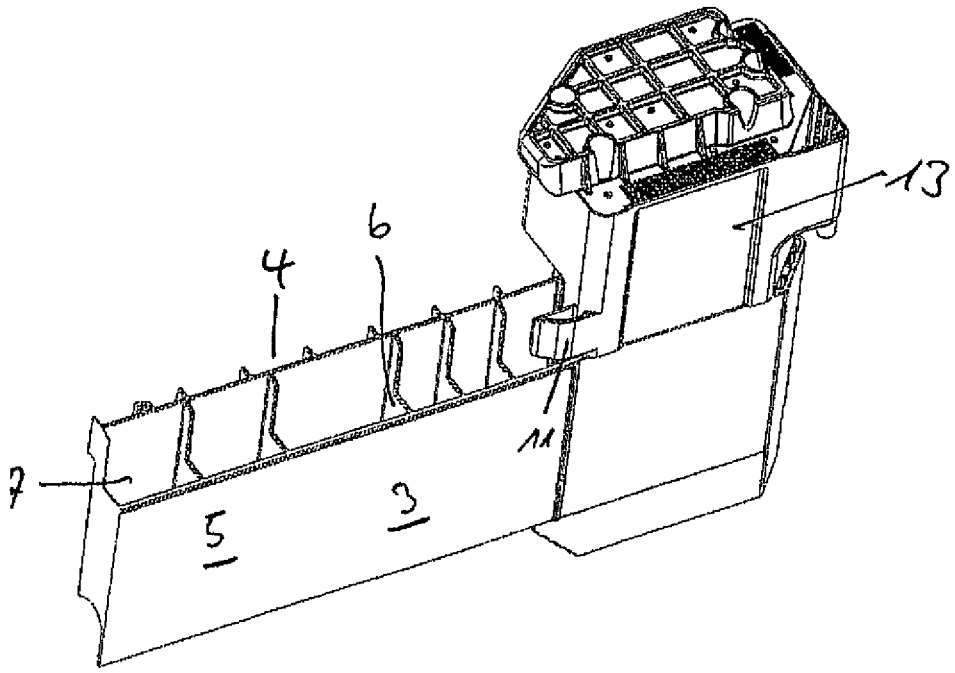

FIG. 12 protective profile according to the fourth alternative in a view from the front and from the rear FIG. 13 view of the detail from FIG. 1 from below, without the protective profile being inserted In FIGS. 1, 4, 7, and 10, a corner region of a large load carrier is shown, which is indicated in general with the reference symbol 1. The large load carrier 1 consists of a bottom 2, which is surrounded by a double-wall frame 3. The structure of this frame is more precisely evident from FIG. 13.

From this drawing, it is also evident that the rear wall 4 of the frame 3 reaches further down than the front wall 5 of the frame.

The vertical crosspieces 6 that are vertically disposed and connect the front and rear wall with one another can also be seen.

A protective profile 8 is laid into the recess 7 formed by the different lengths of front and rear wall, which profile has recesses 10 at its ends 9, into which tongues 11 engage, which tongues are formed onto a foot 13 installed onto the bottom in the lateral corner region.

The protective profile 8 of the four different embodiments of this invention all have in common that an insertion strip 15 is injection-molded onto the upper edge 14 of the actual protective profile 8, which strip is inserted into the interstice 7 between the inner wall 4 and the outer wall 5 of the frame 3.

As is evident from FIG. 3, vertical recesses 16 are formed in on the protective profile side of the insertion strip 15, which recesses correspond to the crosspieces 6 in the interstice 7 of the frame 3.

As the figure of the back side of the profile 8, 15 shows, the insertion strip 15 has a front wall that is continuous with the exception of the recesses 16, which wall lies against the inside of the front wall 5 of the frame 3, and has a shank 17 that proceeds horizontally from this front wall and connects the front wall 5 and the rear wall 4 with one another in the inserted state. To increase the stability, the insertion strip 15 and the protective profile 8 are reinforced with perpendicular intermediate walls 18.

In the figures, parts that are the same are provided with the same reference symbols, in each instance. In the following, the protective profiles 8 that have different configurations will now be described. The protective profile 8 shown in FIGS. 2 and 3 has a cross-section that is approximately U-shaped and open to the outside, whereby the lower U shank makes a transition into a crosspiece 19 that is disposed horizontally and points in the direction of the rear wall 4. Above the crosspiece 19, another horizontal crosspiece 20 is provided, which also supports itself on the rear wall 4, like the crosspiece 19.

In FIGS. 5 and 6, a second alternative of the protective profile 8 is shown. It has a shoulder 21 directed in the direction of the inner wall 4, horizontally from the insertion part 15, but this shoulder ends at a distance from this inner wall 4 and makes a transition there into a vertical region 22, which reaches all the way to the inner wall 4 at its end, in the shape of an arc. In the case of this exemplary embodiment, as well, another horizontal crosspiece 23 is provided for supporting the profile 8 on the inner wall 4.

For further reinforcement, a metal profile strip 30 that is also L-shaped and is held by means of the tongues 11 can also be laid into the profile 8.

In FIGS. 8 and 9, a third alternative of a protective profile 8 is shown, in which a vertical region 24 runs downward, at first, from the insertion strip part 15, and them makes a transition into a slanted region 25, in an obtuse angle, whereby the slant runs in the direction of the inner wall 4. A crosspiece strip that reaches horizontally all the way to the inner wall 4 is formed onto the end of this slanted region 15.

Two crosspieces 26 are provided both in the vertical region and in the slanted region, but they end at a distance in front of the inner wall 4. Because of the elastic properties of the profile material (plastic), the profile 8 absorbs part of the energy when the forklift forks attack it, until the crosspieces 26 lie against the inner wall 4.

Finally, in FIGS. 11 and 12, a fourth alternative is shown, which differs from the third alternative only in that the vertical region 24 was left out. The two exemplary embodiments have in common a projection 27 that projects outward, is situated at the transition of the profile 8 to the insertion strip part 15, and lies against the lower edge of the outer wall 5 of the frame 3.

The invention claimed is:

1. A large load carrier made of plastic, comprising:

a bottom that accommodates loads;

standing feet disposed on an underside of the bottom, at least in corner regions of the bottom;

a double-wall frame surrounding the bottom, the double-wall frame having an inner wall and an outer wall that are connected with one another by way of vertical crosspieces;

strip-shaped protective profiles each disposed in a lower region of the frame, between two of the standing feet, wherein a back side of each protective profile is supported on the inner wall of the frame, wherein each of said protective profiles is a plastic part, and wherein an insertion strip is formed onto a longitudinal edge of each protective profile for insertion into an interstice between the inner and outer wall of the frame and forms a unit with the profile.

2. The large load carrier according to claim 1, wherein each insertion strip has recess slots for accommodating the crosspieces that connect the inner and outer wall with one another.

3. The large load carrier according to claim 1, wherein each protective profile has a U-shaped cross-section that faces the outside, which is supported on the inner wall of the frame by horizontal crosspieces.

4. The large load carrier according to claim 1, wherein each protective profile has a cross-section in a shape of an inverted L, wherein a vertical L shank of the profile is guided in an arc all the way to the inner wall of the frame, at an end of the profile.

5. The large load carrier according to claim 4, wherein a metal profile having an L-shaped cross-section is inserted into a region of the protective profile having the inverted L-shaped cross-section.

6. The large load carrier according to claim 1, wherein each protective profile has a region that proceeds vertically from the insertion strip, in cross-section, from which region a slanted region runs in a direction of the inner wall of the frame, at an obtuse angle, wherein an end of said slanted region has a horizontal region that is supported on the inner wall of the frame, and wherein crosspieces proceed horizontally both from the vertical region and from the slanted region, which crosspieces have a distance from the inner wall of the frame in an unstressed state.

7. The large load carrier according to claim 6, wherein a projection that projects outward is provided on the each profile, at a transition to the insertion strip, which projection lies against a lower edge of the outer wall of the frame.

8. The large load carrier according to claim 1, wherein the insertion strip is configured in L shape in cross-section, wherein a vertical L shank of the insertion strip lies against an inside of the outer wall of the frame, while a horizontal L shank of the insertion strip connects insides of the outer wall and inner wall with one another, wherein vertical intermediate walls are provided over an entire length of the insertion strip, at a distance from one another.

9. The large load carrier according to claim 1, wherein each protective profile has a region that runs at a slant from the insertion strip in the direction of the inner wall of the frame, an end of which slanted region runs horizontally in a direction of the inner wall and is supported there, wherein horizontal strips proceed from the slanted region in the direction of the inner wall, which strips have a distance from the inner wall in an unstressed state.

* * * * *